US011311783B1

(12) United States Patent
DeMille et al.

(10) Patent No.: US 11,311,783 B1
(45) **Date of Patent: *Apr. 26, 2022**

(54) SUPPORT STRUCTURES FOR GOLF CLUB HEAD

(71) Applicant: Callaway Golf Company, Carlsbad, CA (US)

(72) Inventors: Brandon D. DeMille, Carlsbad, CA (US); William C. Watson, Menifee, CA (US); Dominic LeBlanc, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/199,297

(22) Filed: Mar. 11, 2021

Related U.S. Application Data

(63) Continuation-in-part of application No. 17/092,630, filed on Nov. 9, 2020, now Pat. No. 11,130,029, which is a continuation of application No. 16/836,682, filed on Mar. 31, 2020, now Pat. No. 10,835,789, which is a continuation-in-part of application No. 29/703,641, filed on Aug. 28, 2019, now Pat. No. Des. 914,814, and a continuation-in-part of application No. 29/673,358, filed on Dec. 13, 2018, now Pat. No. Des. 880,631.

(51) Int. Cl.
*A63B 53/04* (2015.01)

(52) U.S. Cl.
CPC ..... *A63B 53/0487* (2013.01); *A63B 53/0412* (2020.08)

(58) Field of Classification Search
CPC .. A63B 53/045; A63B 53/0487; A63B 53/007
USPC ..... 473/324–350
See application file for complete search history.

(56) References Cited

U.S. PATENT DOCUMENTS 1,658,581 A * 2/1928 Tobia ..... A63B 60/00 D21/733
4,010,958 A * 3/1977 Long ..... A63B 53/0487 473/341
4,313,607 A * 2/1982 Thompson ..... A63B 53/0466 473/328
4,511,145 A * 4/1985 Schmidt ..... A63B 53/0466 473/346
5,000,454 A 3/1991 Soda
5,290,032 A * 3/1994 Fenton ..... A63B 53/047 473/332
5,295,689 A * 3/1994 Lundberg ..... A63B 53/0466 473/346
5,447,307 A * 9/1995 Antonious ..... A63B 60/00 473/350

(Continued)

*Primary Examiner* — Alvin A Hunter

(74) *Attorney, Agent, or Firm* — Rebecca Hanovice; Michael Catania; Sonia Lari

(57) ABSTRACT

A golf club head comprising at least one structural support member is disclosed herein. The structural support member has a smooth, organic-looking aesthetic and connects unsupported portions of the golf club head to improve the acoustics of the golf club head upon impact with a golf ball. Where the support member connects to other portions of the golf club head, the surfaces of the member have a curvature that changes smoothly and continuously, lacking any sharp corners.

20 Claims, 14 Drawing Sheets

(56) References Cited

U.S. PATENT DOCUMENTS 5,451,058 A * 9/1995 Price ..... A63B 53/0466 473/340
5,467,983 A 11/1995 Chen
5,549,297 A * 8/1996 Mahaffey ..... A63B 60/54 473/290
5,839,975 A * 11/1998 Lundberg ..... A63B 60/00 473/346
5,851,160 A * 12/1998 Rugge ..... A63B 60/00 473/349
6,309,311 B1 * 10/2001 Lu ..... A63B 60/00 473/340
6,334,817 B1 * 1/2002 Ezawa ..... A63B 53/0466 473/324
6,558,271 B1 * 5/2003 Beach ..... A63B 60/00 473/334
6,875,130 B2 * 4/2005 Nishio ..... A63B 53/0466 473/345
7,077,758 B2 * 7/2006 Rohrer ..... A63B 53/0487 473/340
7,371,185 B1 * 5/2008 Rohrer ..... A63B 53/0487 473/340
7,384,345 B2 * 6/2008 Sherman ..... A63B 53/065 473/340
7,442,132 B2 * 10/2008 Nishio ..... A63B 53/0466 473/346
7,588,499 B2 * 9/2009 Tateno ..... A63B 60/02 473/340
7,854,364 B2 12/2010 DeShiell et al.
7,854,665 B2 * 12/2010 Dewhurst ..... A63B 53/0466 473/340
7,914,393 B2 3/2011 Hirsch et al.
8,070,623 B2 * 12/2011 Stites ..... A63B 53/0466 473/346
8,142,308 B2 * 3/2012 Gillig ..... A63B 53/0466 473/324
8,187,116 B2 5/2012 Boyd et al.
8,469,834 B2 * 6/2013 Wada ..... A63B 53/0466 473/346
8,475,292 B2 * 7/2013 Rahrig ..... A63B 53/0466 473/335
8,608,585 B2 * 12/2013 Stites ..... A63B 53/047 473/282
8,915,794 B2 * 12/2014 Stites ..... A63B 60/02 473/291
9,079,078 B2 7/2015 Greensmith et al.
9,393,471 B2 * 7/2016 Beno ..... A63B 53/0466
9,393,473 B2 * 7/2016 Knight ..... A63B 60/54
9,486,677 B1 11/2016 Seluga et al.
9,597,558 B1 * 3/2017 Seluga ..... A63B 60/00
9,597,561 B1 * 3/2017 Seluga ..... A63B 60/52
9,821,199 B1 * 11/2017 Seluga ..... A63B 60/50
9,855,475 B2 * 1/2018 Motokawa ..... A63B 60/50
9,889,349 B1 * 2/2018 Seluga ..... A63B 60/00
9,901,794 B2 * 2/2018 Beno ..... A63B 53/0466
9,931,550 B1 * 4/2018 Seluga ..... A63B 60/52
9,981,167 B2 5/2018 Seluga et al.
9,987,527 B1 * 6/2018 Myers ..... A63B 53/0466
10,258,846 B1 * 4/2019 Nunez ..... A63B 53/06
10,343,031 B1 * 7/2019 Day ..... A63B 60/002
10,384,107 B2 * 8/2019 Knight ..... A63B 53/047
10,512,826 B1 * 12/2019 Frederickson ..... A63B 53/06
10,532,258 B2 * 1/2020 Seluga ..... B22C 7/02
10,617,920 B2 * 4/2020 Nunez ..... A63B 60/00
10,835,789 B1 * 11/2020 DeMille ..... A63B 53/0487
11,130,029 B2 * 9/2021 DeMille ..... A63B 53/0487

* cited by examiner

SUPPORT STRUCTURES FOR GOLF CLUB HEAD

CROSS REFERENCES TO RELATED APPLICATIONS

The present application is a continuation-in-part of U.S. patent application Ser. No. 17/092,630, filed on Nov. 9, 2020, which is a continuation of U.S. patent application Ser. No. 16/836,682, filed on Mar. 31, 2020, and issued on Nov. 17, 2020, as U.S. Pat. No. 10,835,789, which claims priority to U.S. Provisional Patent Application No. 62/892,924, filed on Aug. 28, 2019, and is a continuation-in-part of U.S. Design patent application Ser. No. 29/673,358, filed on Dec. 13, 2018, and issued on Apr. 7, 2020, as U.S. Design Pat. No. D880,631, and is a continuation-in-part of U.S. Design patent application Ser. No. 29/703,641, filed on Aug. 28, 2019, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head with structures that provide optimized support to otherwise unsupported portions of the club head and improve overall club head acoustics.

Description of the Related Art

Golf club manufacturers spend a great deal of time and energy attempting to optimize the acoustics of their products upon impact with a golf ball. These efforts include foam injections, integrally formed rib structures, and linear pillars connecting crown and sole surfaces.

Unfortunately, these solutions are not ideal. For example, foam can help dampen sound, but does not improve stiffness or control for pitch, and is difficult to add with precision to specific parts of the golf club head. Furthermore, while integrally formed ribs can improve stiffness and pitch, they provide very little damping control, and do not allow manufacturers to choose damping or reinforcement material. There are also significant manufacturing constraints related to ribs. For example, their aspect ratio (height to wall thickness) is limited by the machining techniques employed to cut the wax tooling, and their inclusion leads to the potential for sink marks on the outer mold line of the part, which hurt cosmetics or require additional effort to finish. Ribs also are typically limited in position and orientation by the pull direction of the pick for the wax tooling in that portion of the club head.

Linear pillars made from a non-metal material that are affixed to the body to connect crown and sole surfaces, such as those disclosed in U.S. Pat. No. 7,914,393 to Hirsch et al. and U.S. Pat. No. 9,079,078 to Greensmith et al., also have their limitations. The extruded tubes or support rods typically used are inexpensive and stiff, but only offer two points of connection, and therefore two points of reinforcement, to the golf club body. There is very little freedom to change the design of extruded or pultruded tubes or rods beyond a constant cross section, constant wall thickness, and length.

Another critical limitation for rods (either integrally formed or formed separately) is that there is no simple way to join rods to each other, as traditional CAD modeling techniques used to design golf club heads lend themselves to certain, angular styles or appearances. Specifically, as shown in FIGS. 1-3, tangency T between neighboring surfaces is common, but these transitions do not typically have smooth curvatures, especially where two or more slender structural elements intersect. In fact, as shown in FIGS. 4-5, the surface curvature changes along the spline of the structural elements are discrete. Furthermore, these traditional connections are subject to increased strain and breakage.

Therefore, there is a need for a golf club head with improved structural support members and connectivity between those support members and other parts of the golf club head that provide adequate support and improve acoustics of the golf club head upon impact with a golf ball.

BRIEF SUMMARY OF THE INVENTION

The present invention is directed to a golf club head comprising support structures that: (1) are less susceptible to stress concentrations during the use of the structural part or component; (2) allow for improved flow and reduced porosity in investment casting operations; (3) allow for improved flow and reduced porosity in plastic injection molding, metal injection molding, and compression molding; (4) are less susceptible to local stress concentrations and cracking during sintering; (5) are less susceptible to local stress concentrations and cracking during the build process for laser-based 3D printing methods, like direct metal laser melting (DMLM) or direct metal laser sintering (DMLS); and/or (6) provide optimal acoustics upon impact with a golf ball. The support structures of the present invention have an "organic" appearance that is not found in prior art structural golf club parts.

Another aspect of the present invention is a golf club head comprising a body comprising a face, a sole portion extending from a bottom edge of the face, a top portion extending from a top edge of the face, and a weight port disposed at a rear edge of the body, the body having a hollow interior and a volume of 150 to 500 cubic centimeters, and a structure comprising at least one support member, the structure extending between and connecting the sole portion, the top portion, and the weight port, wherein the at least one support member comprises a first end, a second end, a surface, an equivalent diameter, a spline, and a cross-sectional shape, wherein the equivalent diameter $D_E$ of a cross section taken at any point along the spline is calculated using the formula $D_E=(4*A/pi)\hat{}(½)$, wherein A is an area of a cross-section of the support member, wherein the at least one support member has a length that is greater than $D_{EA}$, wherein $D_{EA}$ is defined as the average equivalent diameter along the length of the entire support member, wherein the equivalent diameter is always greater than 0.010 inch and less than 1.000 inch, and wherein the spline is curved and has a length that is at least three times the value of the average equivalent diameter $D_{EA}$.

In some embodiments, the golf club head may be a driver head. In a further embodiment, the at least one support member may connect to the sole portion at a first connection region and to the top portion at a second connection region, and wherein at least one of the first and second connection region may have a constant surface curvature. In other embodiments, a volume occupied by the structure may be no greater than 75% of a volume that would be occupied if an entire volume of the golf club head between the top portion and the sole portion were a solid. In yet another embodiment, the equivalent diameter may be no less than 0.025 inch and no more than 0.500 inch at any point taken along the length of the at least one support member. In a further embodiment, the equivalent diameter may be less than 0.050 inch and no more than 0.250 inch at any point taken along the length of the at least one support member. In any of the embodiments, the equivalent diameter may change continuously along the entire length of the spline.

In another embodiment, the cross-sectional shape may change continuously along the entire length of the spline. In yet another embodiment, the at least one support member may comprise first and second support members, and the first support member may be connected to the second support member. In another embodiment, the at least one support member may not comprise any sharp corners. In another embodiment, the at least one support member may not comprise any fillets with constant surface curvature.

Yet another aspect of the present invention is a golf club head comprising a body comprising a face, a top portion, a bottom portion, and a rear portion connecting rearmost edges of the top portion to rearmost edges of the bottom portion and enclosing a hollow interior, and a support structure entirely disposed within the hollow interior, the support structure comprising a first support member and a second support member, wherein the first support member comprises a first end that connects with one of the top portion, bottom portion, and rear portion and a second end that connects with one of the top portion, bottom portion, and rear portion, wherein the second support member comprises a third end that connects with the first support member and a fourth end that connects with one of the top portion, bottom portion, and rear portion, wherein each of the first support member and the second support member comprises a central region that is suspended within the hollow interior and does not make contact with any other portion of the body, and wherein each one of the first support member and the second support member does not comprise any sharp corners.

In some embodiments, each of the first end, the second end, and the fourth end may connect with the bottom portion. In other embodiments, the first end may connect with the top portion and the second end may connect with the bottom portion. In yet another embodiment, the support structure may dampen the acoustics of the golf club head upon impact with a golf ball, and may also increase the modal frequency of at least one mode shape of the golf club head upon impact with a golf ball. In any of the embodiments, the body may be composed of at least one metal alloy, and the rear portion may be selected from the group consisting of a rear edge and a rear ribbon. In a further embodiment, the support structure may be integrally formed with the body.

In other embodiments, the support structure may be composed of a material selected from the group consisting of plastic and composite. In some embodiments, the support structure may be formed separately from the body via a process selected from the group consisting of metal injection molding, plastic injection molding, compression molding, and 3D printing. In any of the embodiments, each of the first support member and the second support member may not comprise any fillets with constant surface curvature.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
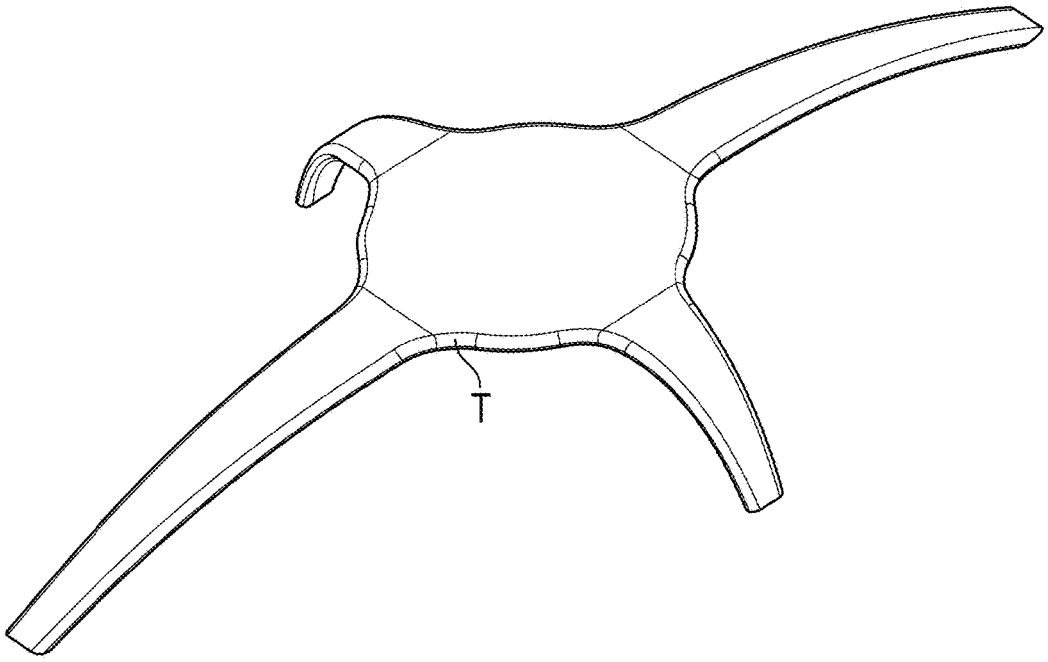
FIG. 1 is top perspective view of a first prior art support structure.
Figure 2:
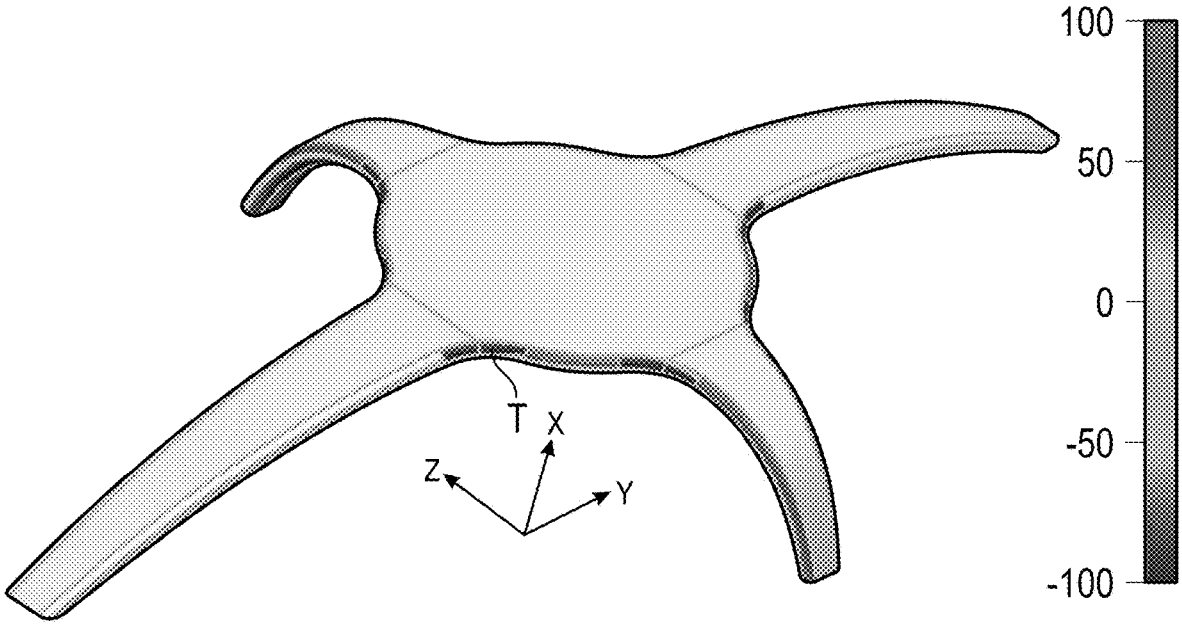
FIG. 2 is a top perspective view of a second prior art support structure.
Figure 3:
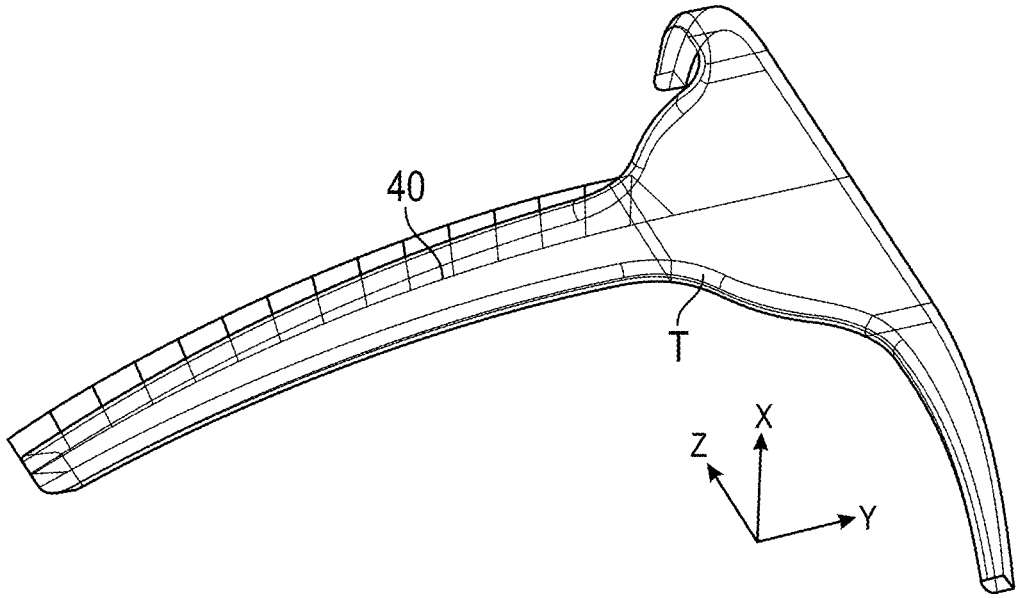
FIG. 3 is a line drawing of a third prior art support structure.
Figure 4:
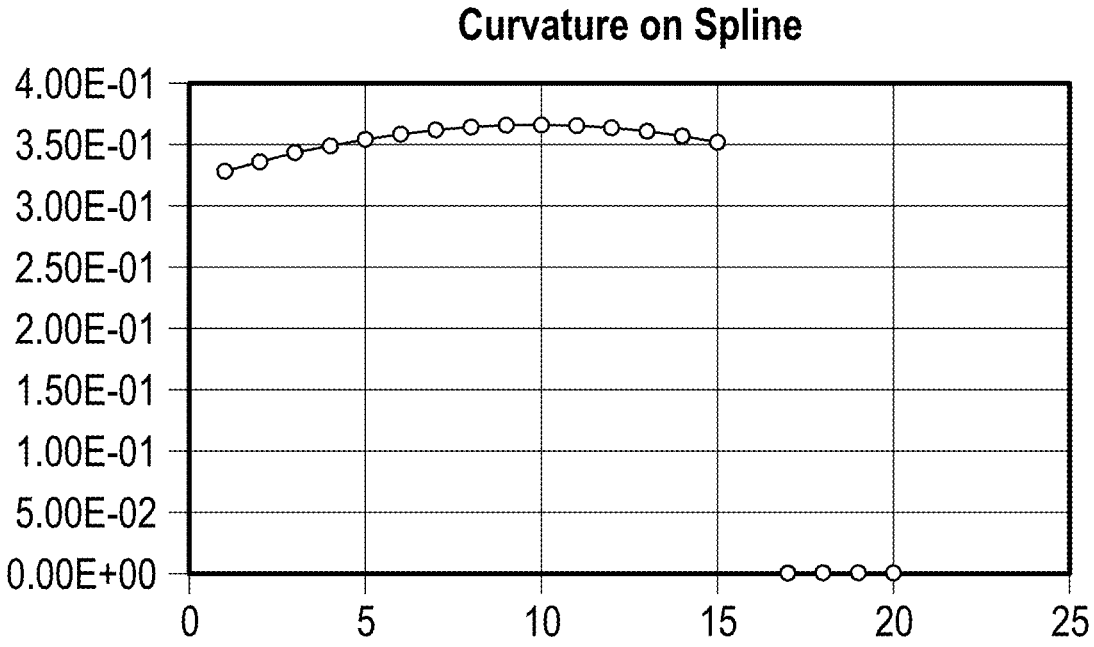
FIG. 4 is a graph showing the curvature of the spline of the embodiment shown in FIG. 3.
Figure 5:
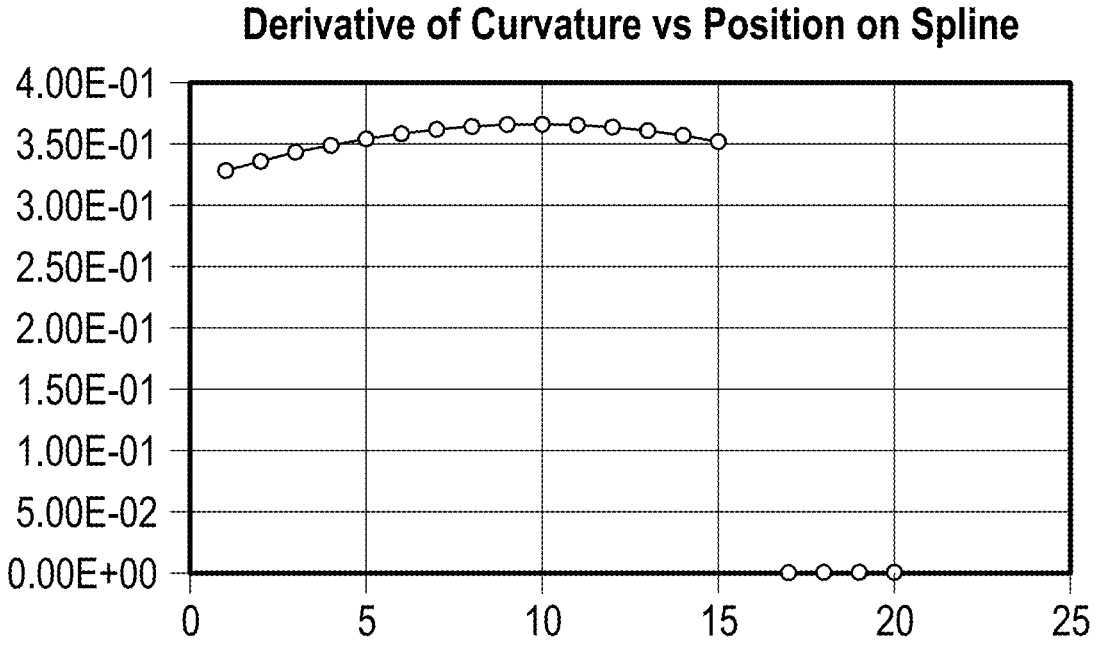
FIG. 5 is a graph showing the derivative of curvature vs. position on spline of the embodiment shown in FIG. 3.
Figure 6:
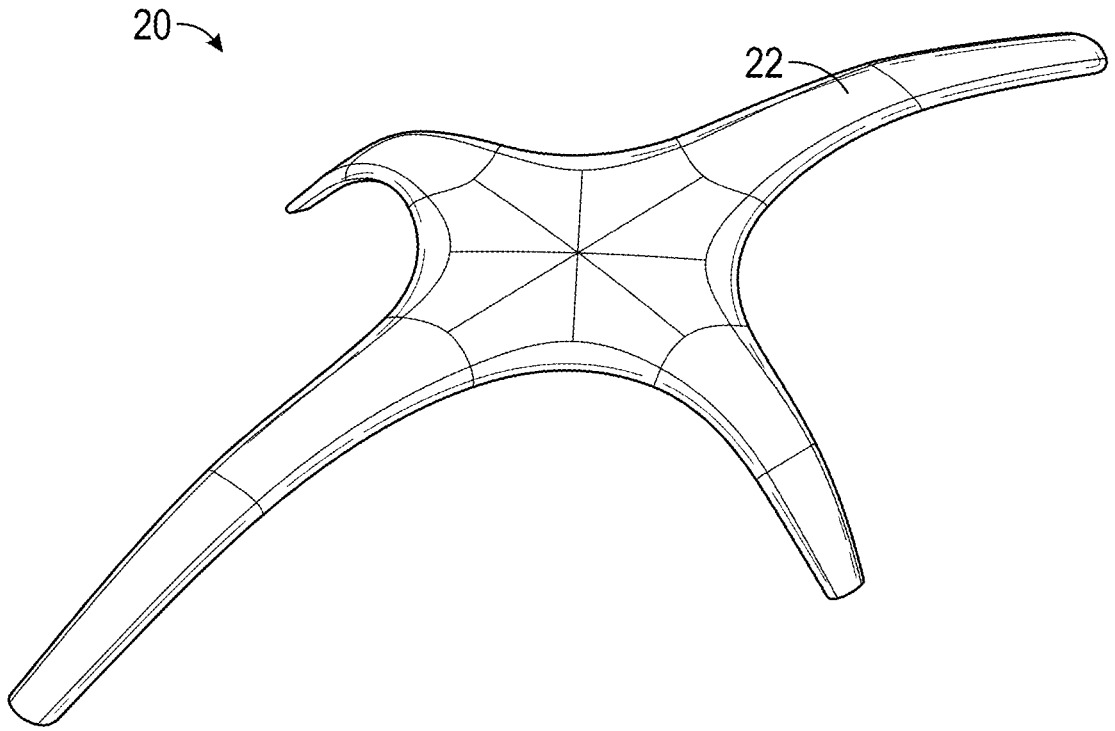
FIG. 6 is a top perspective view of a first embodiment of the support member of the present invention.
Figure 7:
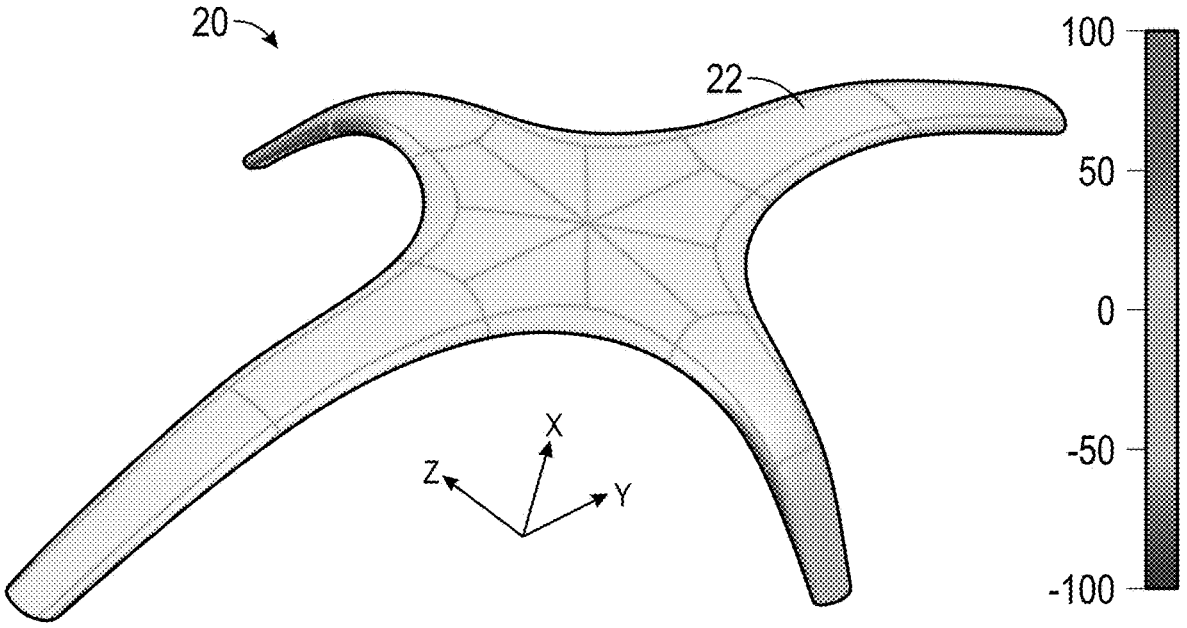
FIG. 7 is a top perspective view of a second embodiment of the support member of the present invention.
Figure 8:
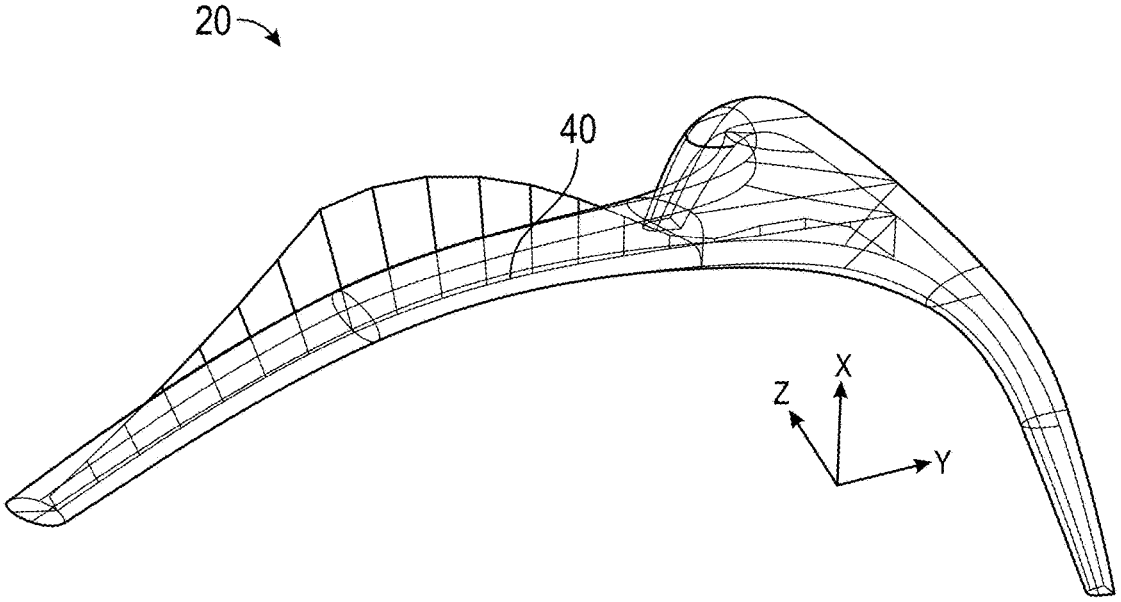
FIG. 8 line drawing of a third embodiment of the support member of the present invention.

The present invention is directed to a golf club head with improved structural support members 20, which may be used in connection with any type of golf club head, such as drivers, fairway woods, irons, wedges, and putters.

Examples of support members 20 engaged with a putter head and a driver head are specifically disclosed herein. The support members 20 are defined by their multiple connection points and internal junctions where members connect to each other, allowing for geometric freedom in the chosen manufacturing method, control over damping (via material selection and structure geometry), and improved pitch (via improved structural stiffness) all at the same time. These support structures 20 are also more mass efficient than prior art support structures, thereby freeing up discretionary mass to be used elsewhere in the club head.

In a first embodiment, shown in FIGS. 12-15, the golf club head is a putter head 10 with a face 16, a sole portion 12 extending from a lower edge 18 of the face 16, and a top or crown portion 14 extending from an upper edge 17 of the face 16. The putter head 10 includes a plurality of the support members 20.

In order to attain an optimized design for the support members 20, the relationship between curvature, rate of change of curvature, spline length, cross-sectional area, and cross-sectional shape of each structure must be examined. By controlling each of these geometric features, support members 20 can be created that are much improved over existing prior art support structures within golf club heads.

The support members 20 of the present invention include networks of slender connected elements, and may also be referred to as rods, beams, or ligaments. Each support member 20 is either connected to another support member 20 or to the surface of another type of structure, such as a sole portion 12 or top or crown portion 14 of the putter head 10. In the first embodiment shown in FIG. 13-15, the support members connect the sole portion 12 to the crown portion 14, but in an alternative embodiment, the support members may attach only to a single surface, such as the face 16. Some support members 20 also have at least one connection to another support member 20. At the connection to another support member 20, the surfaces 22 of the support member 20 have a curvature that changes smoothly and continuously. There are no sharp corners and there are no simple fillets with constant surface curvature.

Figure 9:
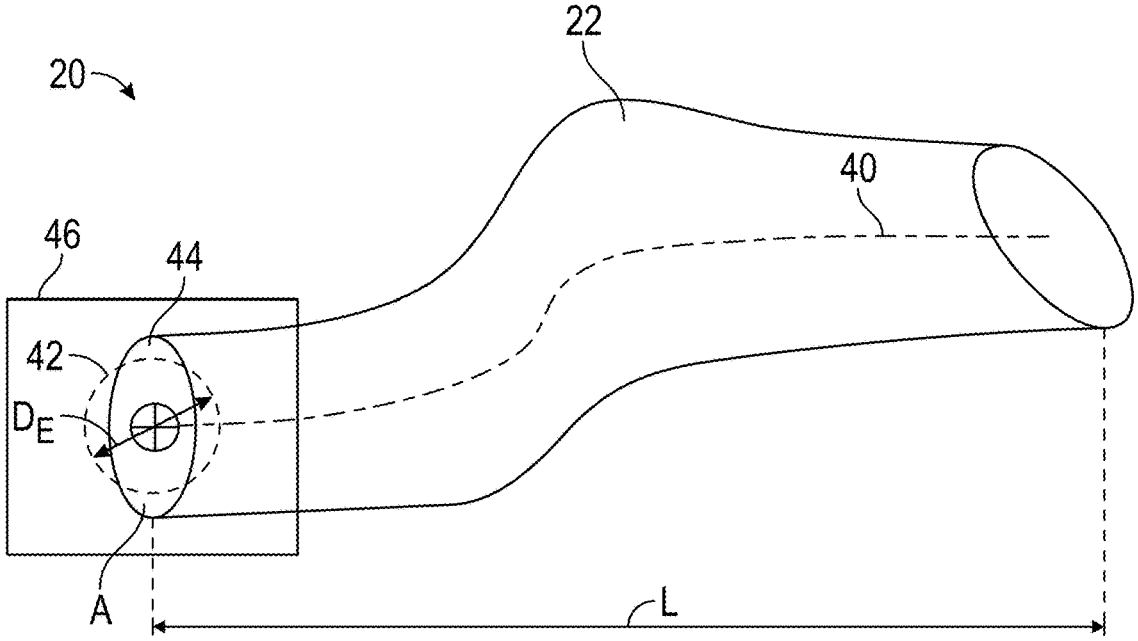
FIG. 9 is a line drawing of a fourth embodiment of the support member of the present invention.

As shown in FIG. 9, for each support member 20, the equivalent diameter $D_E$ is the diameter of a circle 42 with the same area A as the cross section 44 of the support member 20. The cross section 44 is taken in the plane 46 normal to the spline 40 running through the center of the support member 20 along its length. The support member 20 cross section 44 has an area A, and the equivalent diameter $D_E$ is defined as $D_E=(4*A/pi)\hat{}(½)$. The length of the spline 40 is no less than three times the equivalent diameter $D_E$. The equivalent diameter $D_E$ and the cross sectional shape 44 change continuously along the length of each spline 40, but the equivalent diameter $D_E$ is always greater than 0.010" and always less than 1.000", more preferably 0.050"-0.500," and most preferably 0.050"-0.250".

Figure 10:
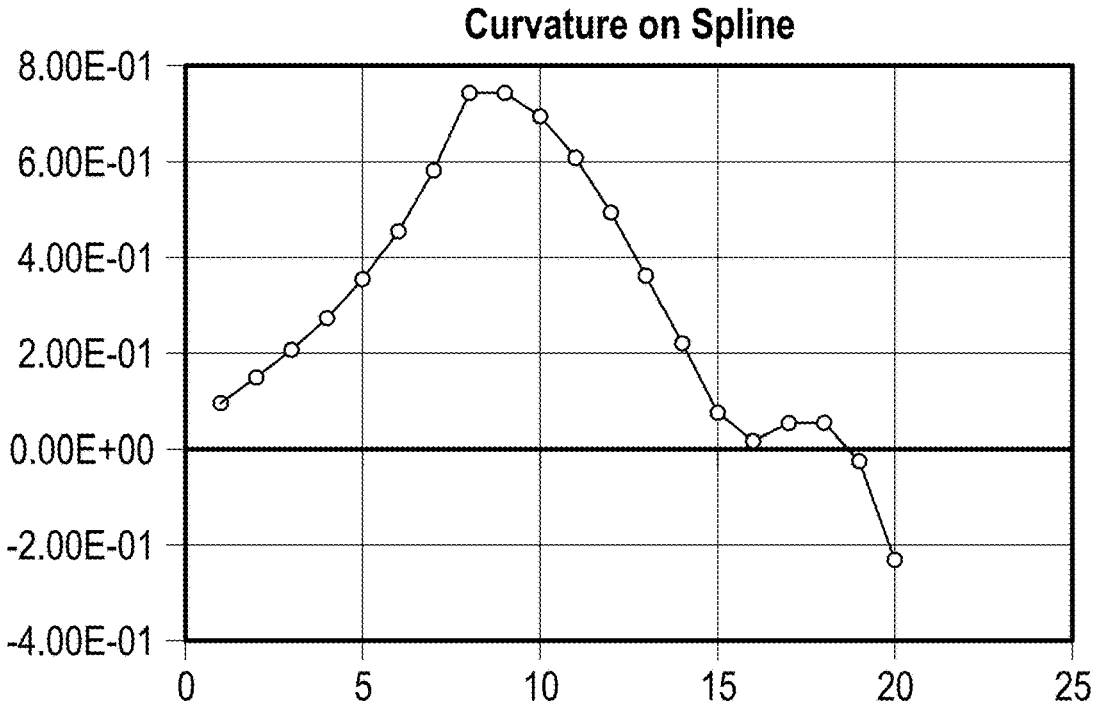
FIG. 10 is a graph showing the curvature of the spline of the embodiment shown in FIG. 8.
Figure 11:
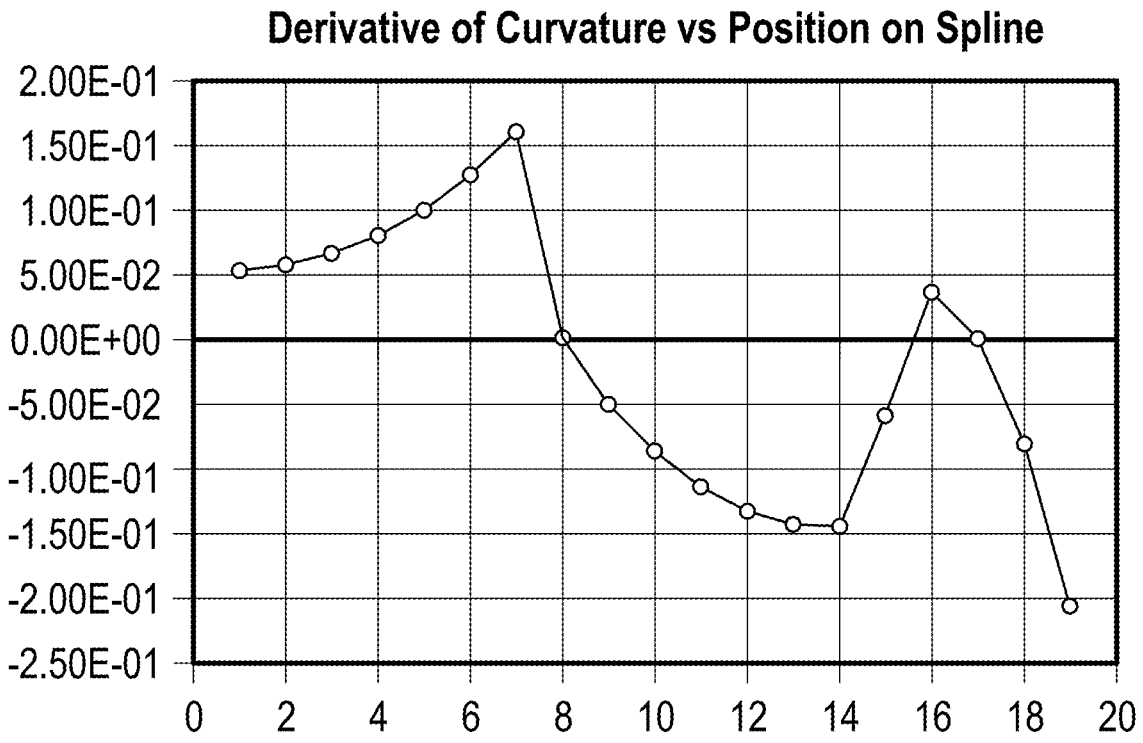
FIG. 11 is a graph showing the derivative of curvature vs. position on spline of the embodiment shown in FIG. 8.
Figure 12:
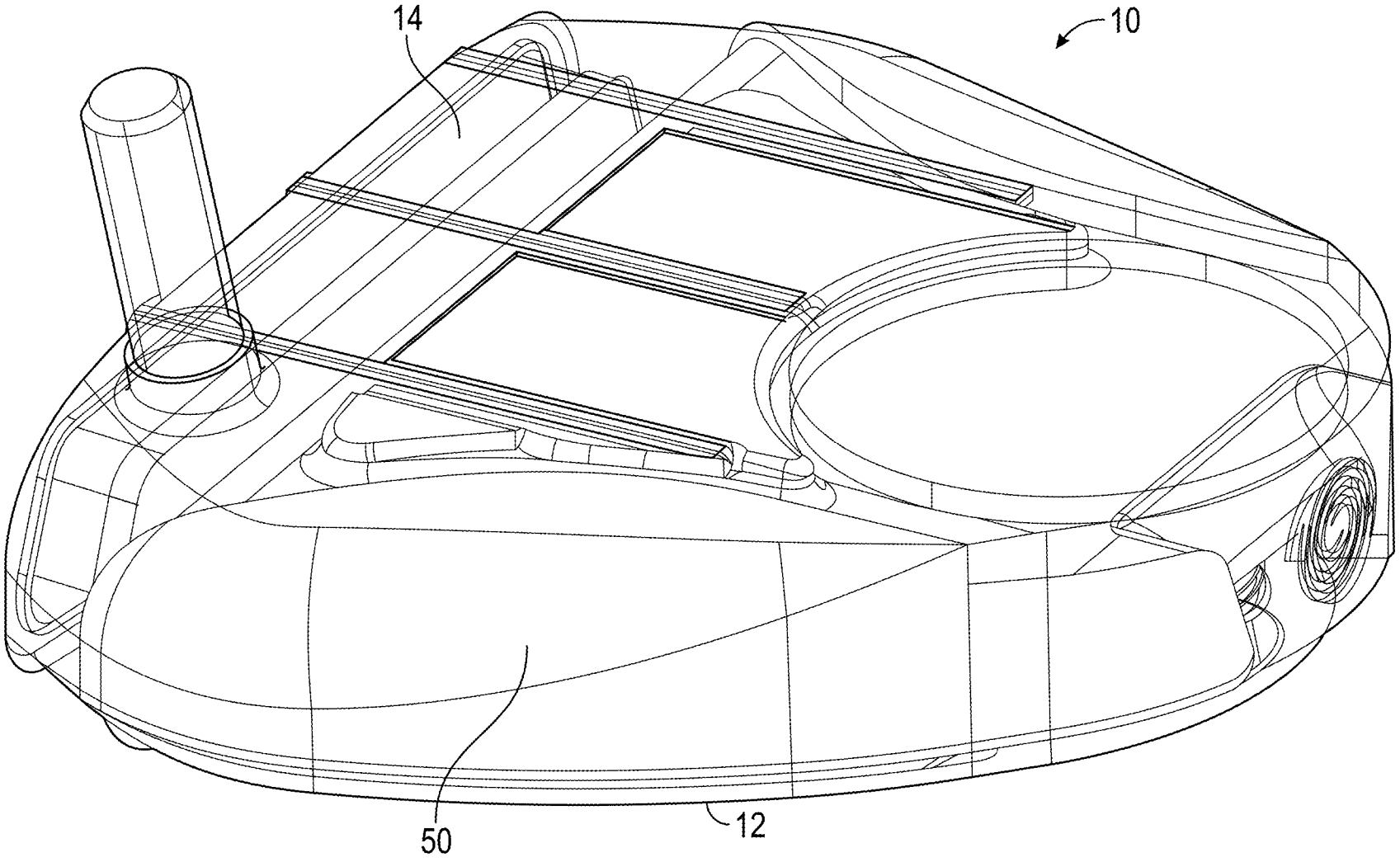
FIG. 12 is a side perspective view of a putter head with shading representing an enclosed volume.
Figure 13:
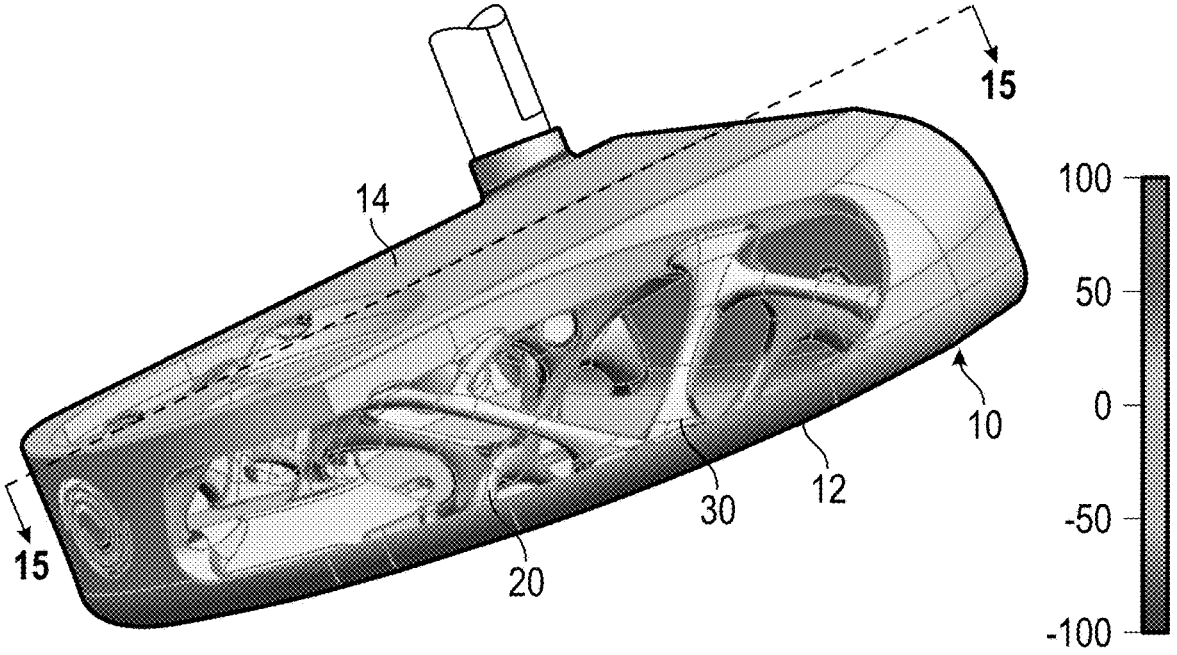
FIG. 13 is a rear perspective view of the putter head shown in FIG. 12 without the enclosed volume shading and incorporating a plurality of support members of the present invention.
Figure 14:
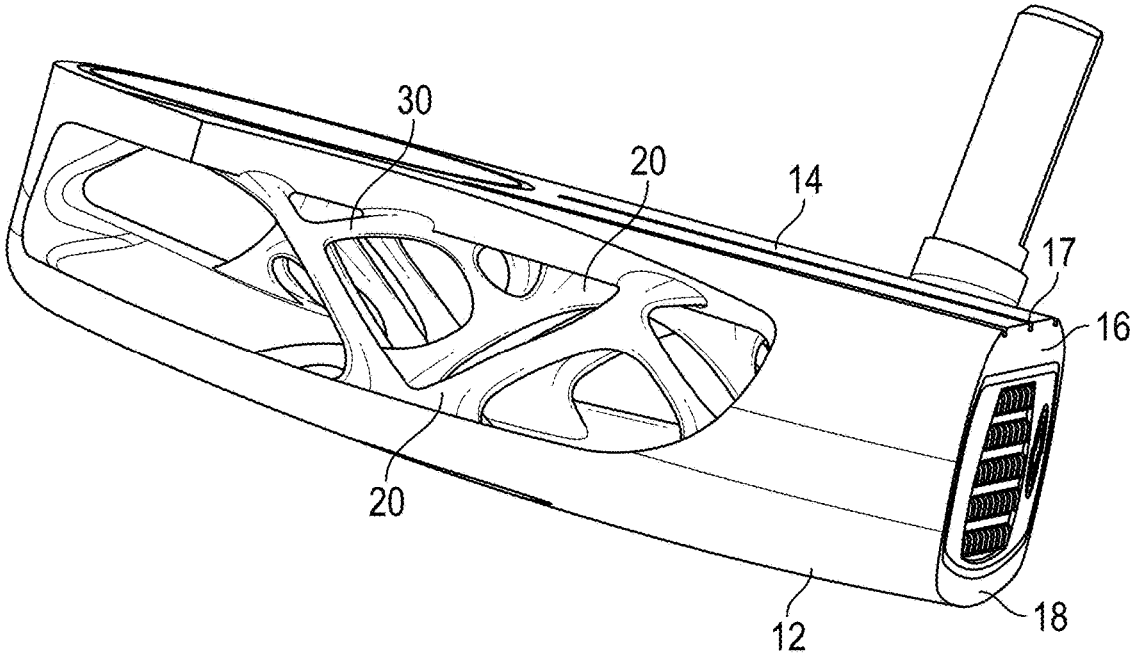
FIG. 14 is a side view of the embodiment shown in FIG. 13.
Figure 15:
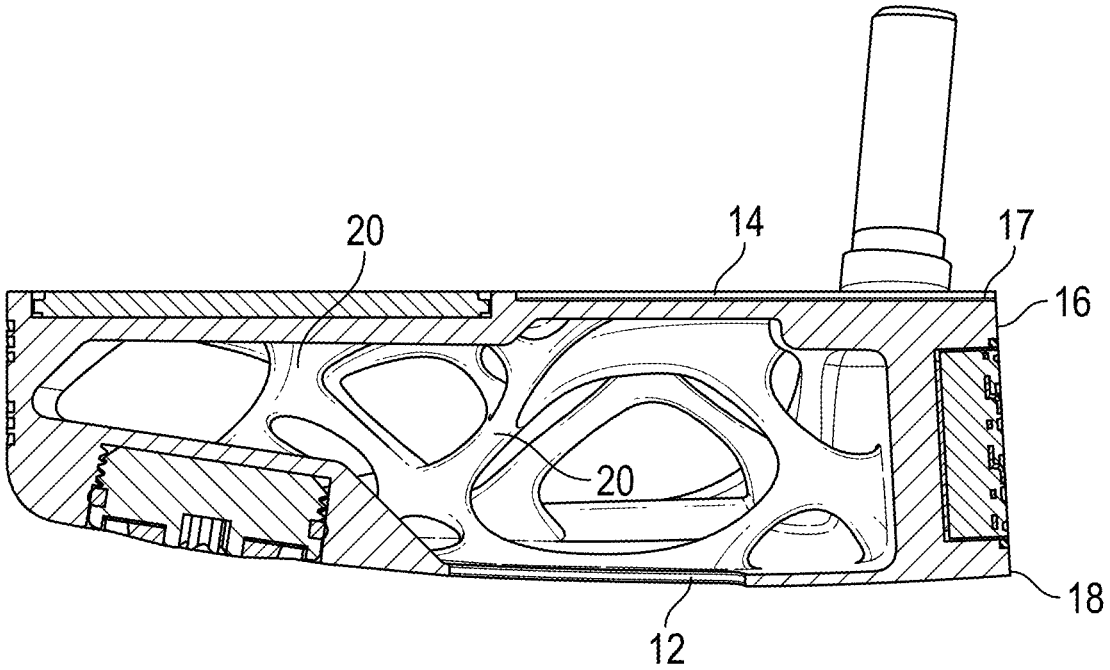
FIG. 15 is a cross-sectional view of the putter head shown in FIG. 13 along lines 15-15.

As shown in FIGS. 6-9, each spline 40 is curved, and as illustrated in FIGS. 10-11, the curvature continuously changes along the length of the spline 40, with specific ranges of curvature and rates of change of curvature. The entire network of support members 20 occupies a volume 30 that is no greater than 75% of the enveloping volume 50. The enveloping volume 50, which is illustrated in FIG. 12, is the total volume that could be occupied by support members 20 given the application.

Figure 16:
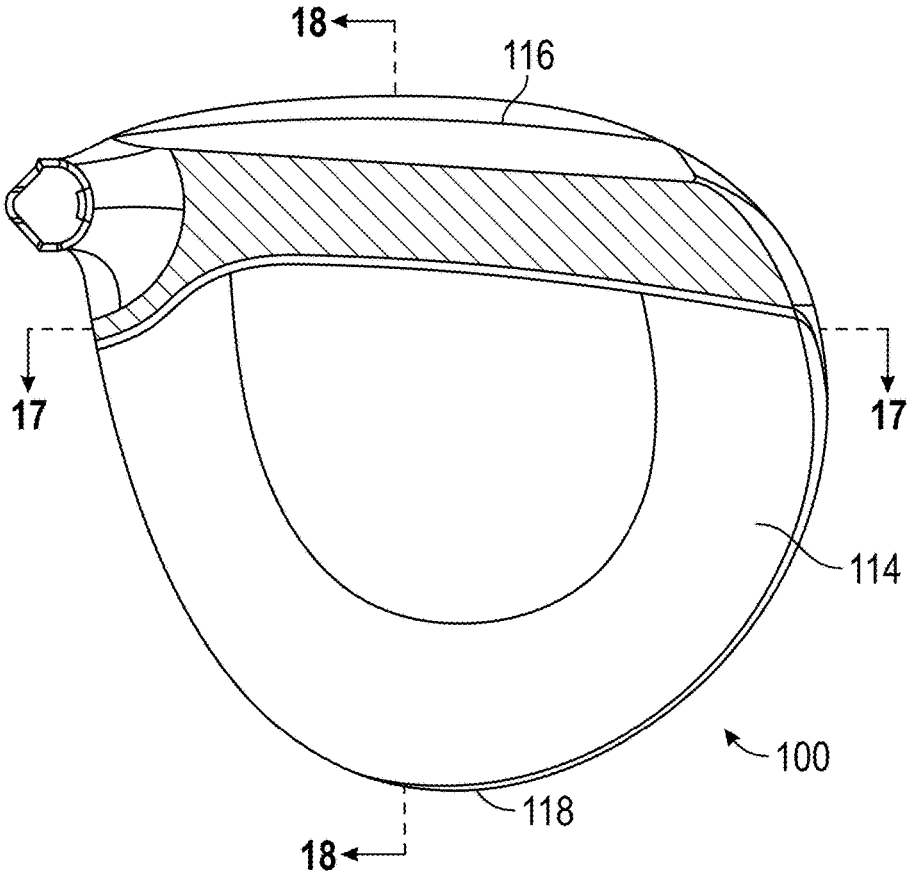
FIG. 16 is a top plan view of another embodiment of a golf club head incorporating support members of the present invention.
Figure 17:
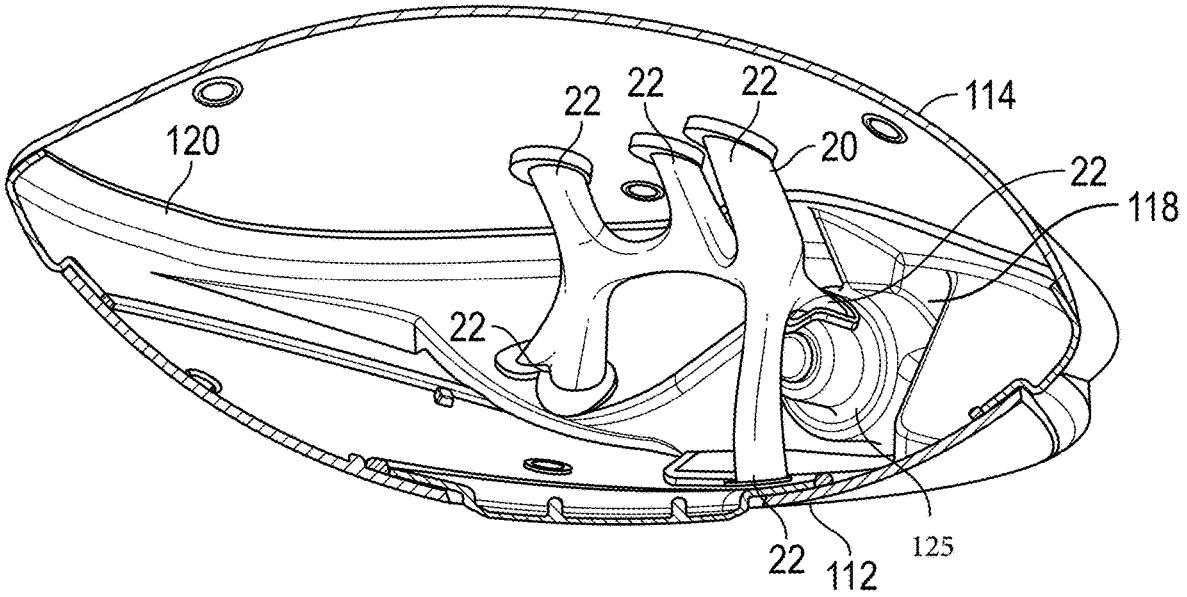
FIG. 17 is a cross-sectional view of the embodiment shown in FIG. 16 taken along lines 17-17.
Figure 18:
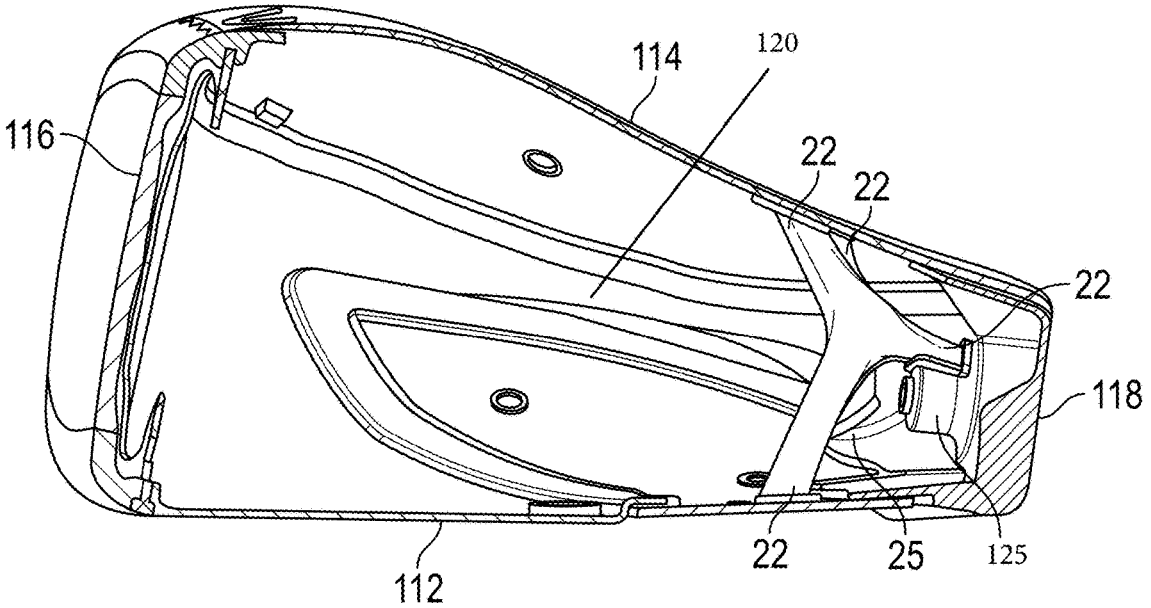
FIG. 18 is a cross-sectional view of the embodiment shown in FIG. 16 taken along lines 18-18.

In another, preferred embodiment, shown in FIGS. 16-18, the golf club head is a driver head 100 (or, in an alternative embodiment, a high-volume fairway wood) with a sole portion 112, a top or crown portion 114, a face portion 116 (which may be an insert), and a rear ribbon portion 118. The sole and crown portions 112, 114 include one or more composite inserts. A structure 25 composed of a plurality of support members is disposed within the interior cavity 120 of the head 100 proximate the rear ribbon portion 118, and the support members 20 making up this structure 25 connect to various surfaces within the interior 120 at six discrete attachment points 22, three at the crown portion 114, two at the sole portion 112, and one at the weight port 125 disposed at the rear ribbon portion 118. The support structure 25 also includes three junctions 24 where the support members 20 intersect with one another. At least one of the support members 20 has continuous curvature throughout at least 20% of its length, and more preferably at least 50% of its length. In another embodiment, one or more of the support members follows the rules outlined above regarding FIGS. 6-11.

Figure 19:
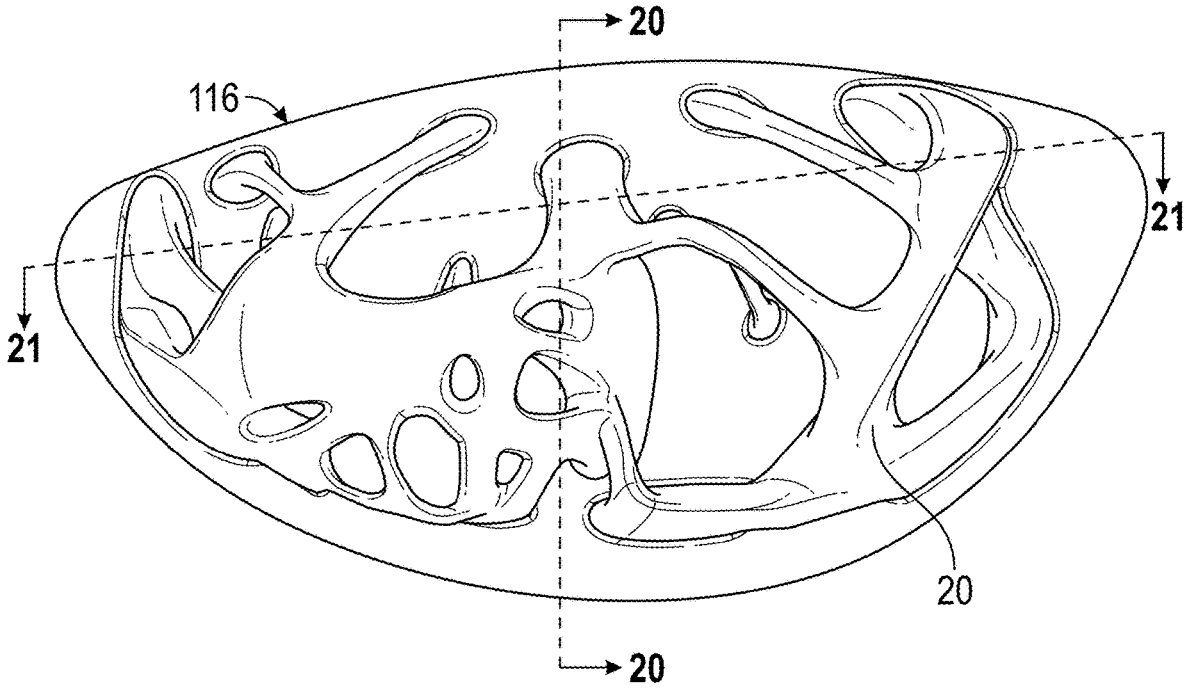
FIG. 19 is a rear perspective view of a face insert of a golf club head incorporating support members of the present invention.
Figure 20:
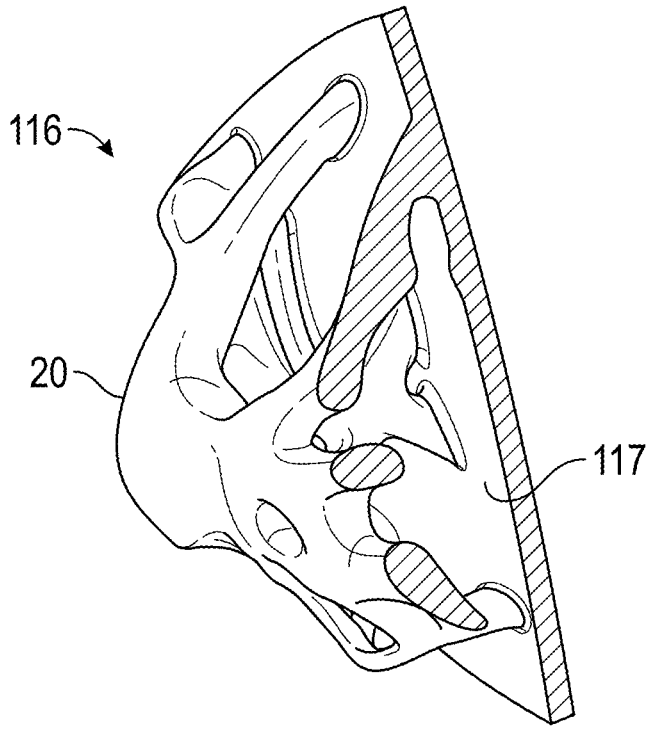
FIG. 20 is a cross-sectional view of the embodiment shown in FIG. 19 taken along lines 20-20.
Figure 21:
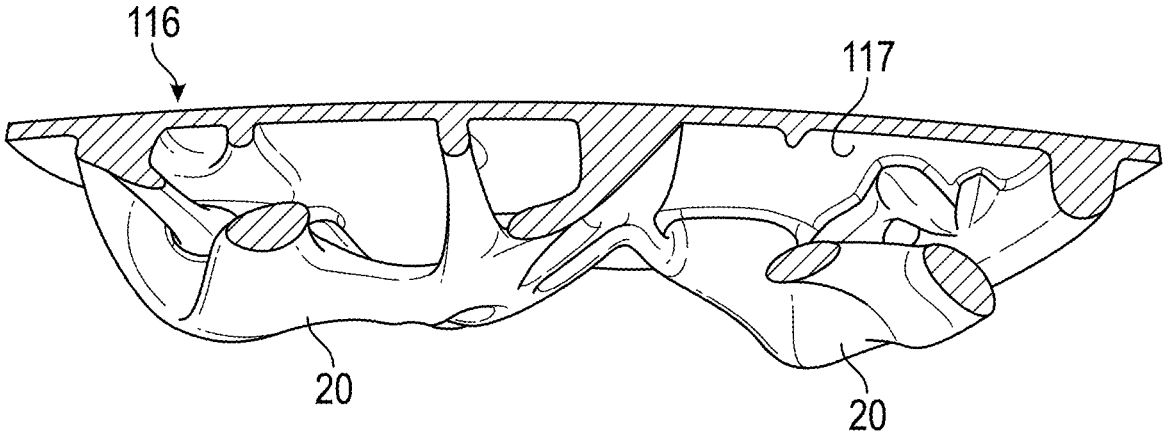
FIG. 21 is a cross-sectional view of the embodiment shown in FIG. 19 taken along lines 21-21.

In another embodiment, shown in FIGS. 19-21, the face insert 116 comprises a plurality of support members 20 that connect to one another and to the rear surface 117 of the face insert 116. This face insert 116 may be used with a golf club head 100 having no other support members 20, or may be used with a golf club head 100 having one or more other support members 20 of the present invention.

Figure 22:
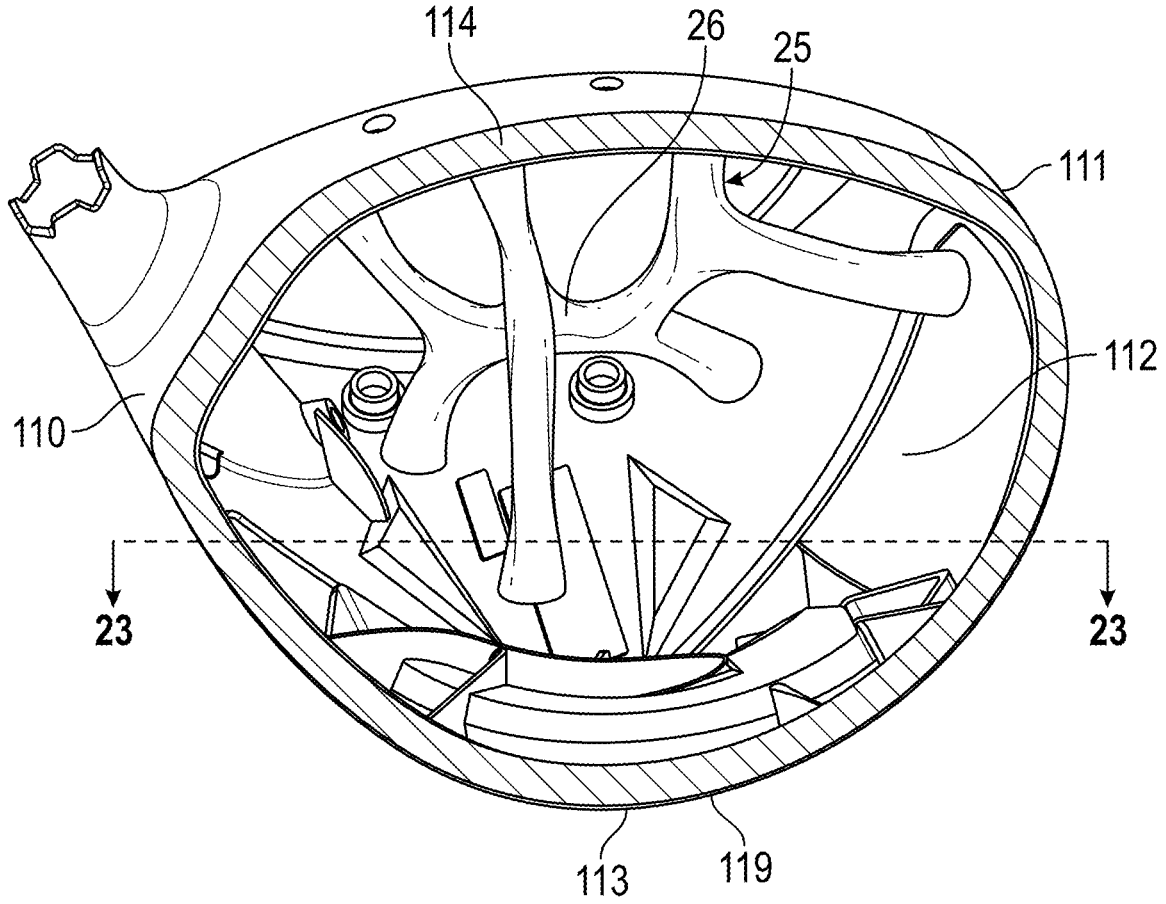
FIG. 22 is a top perspective view of another embodiment of a golf club head incorporating support members of the present invention.
Figure 23:
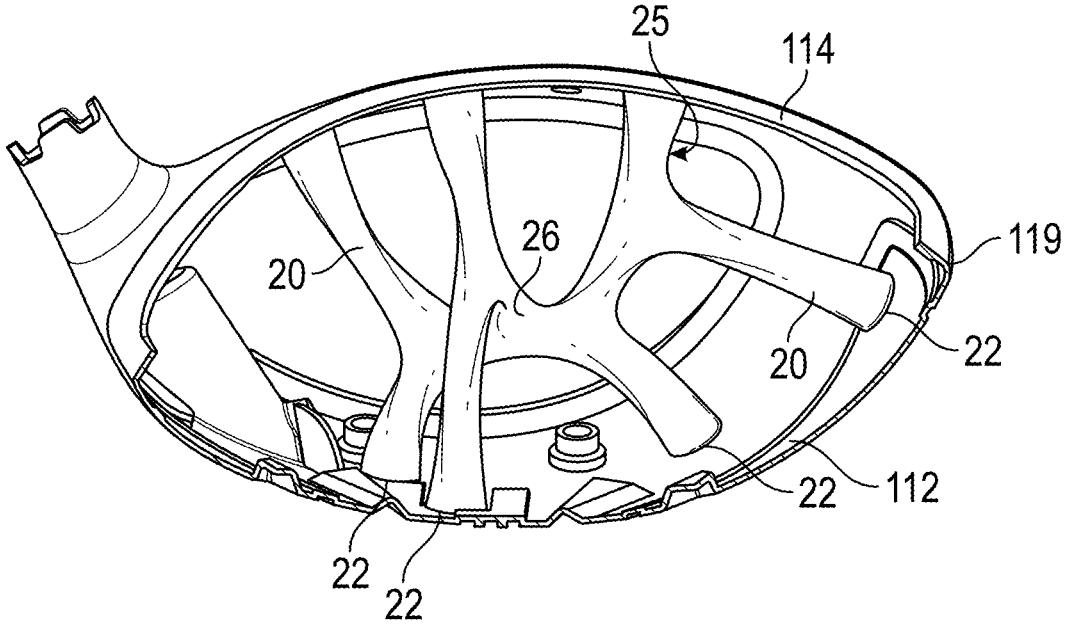
FIG. 23 is a cross-sectional view of the embodiment shown in FIG. 22 taken along lines 23-23.

In another embodiment, shown in FIGS. 22-23, the structure 25 is closer to the face portion 116 or insert and comprises a plurality of support members 20 that connect the top portion 114 to the sole portion 112 and also connect to one another, melding together at a center region 26 of the structure 25. In this embodiment, the golf club head 100 does not have a ribbon portion 118 or rear wall; instead, the top portion 114 connects directly to the sole portion 112 at an edge 119 that extends from the heel side 110 to toe side 111 of the golf club head 100 around an aft end 113.

Figure 24:
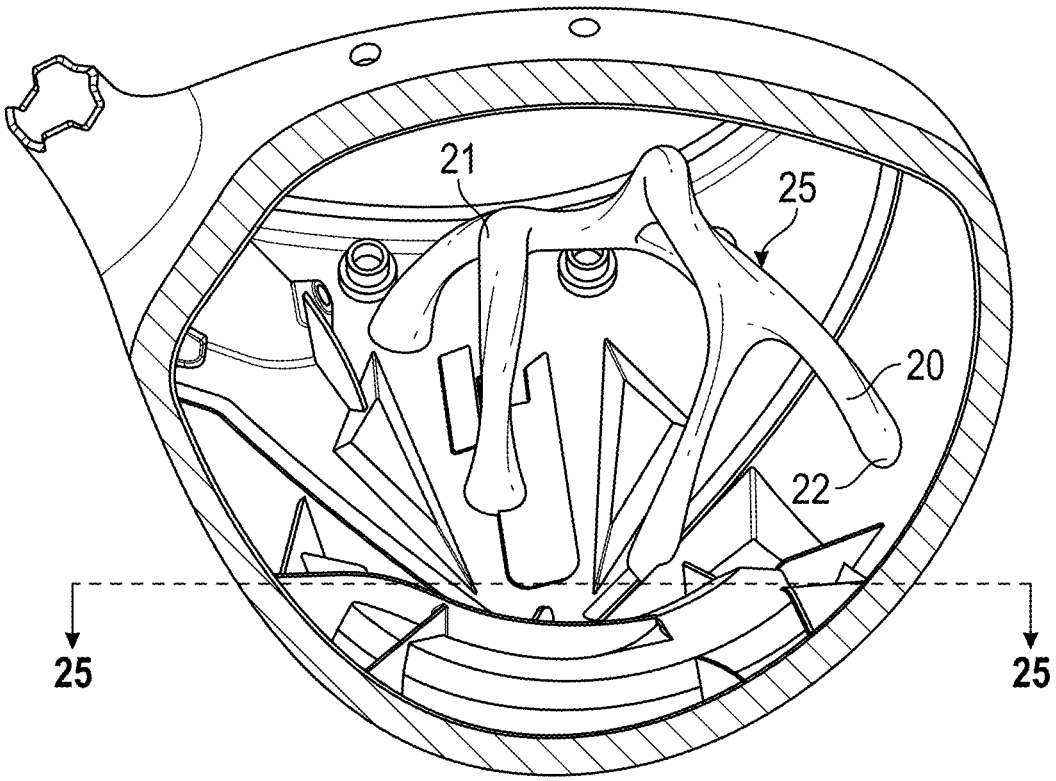
FIG. 24 is a top perspective view of another embodiment of a golf club head incorporating support members of the present invention.
Figure 25:
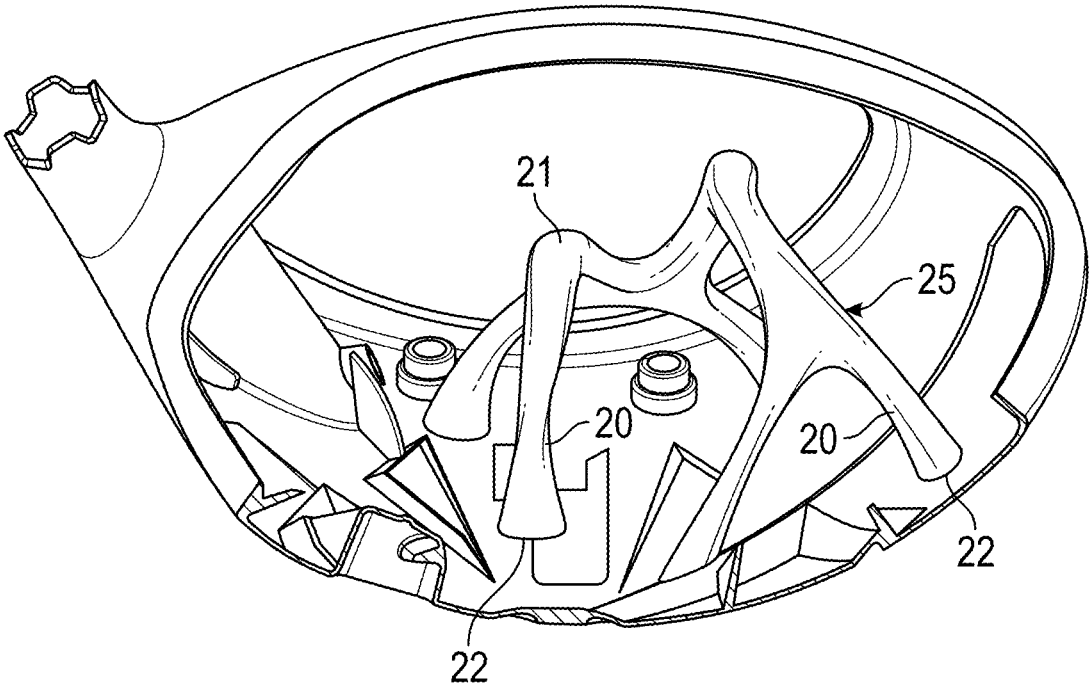
FIG. 25 is a cross-sectional view of the embodiment shown in FIG. 24 taken along lines 25-25.

In yet another embodiment, shown in FIGS. 24-25, the structure extends across the sole portion 112, with each support member 20 making contact with the sole and no other portion of the golf club head 100. Each support member 20 arcs over the sole through the hollow interior cavity 120 and at least its midsection 21, and preferably a majority of its surface area and volume, is suspended within the interior cavity 120 without making contact with any surface of the golf club head 10 other than other support members 20.

The support members 20 shown herein are particularly useful for acoustic improvements in large wood heads like the one shown in FIGS. 16-18 and 23-25. The sole and crown portions 112, 114 are flat and unsupported surfaces that generate high amplitude, low frequency sounds upon impact. The support members 20 are more efficient than prepreg ribs for stiffening the surfaces, as the creation of integrally formed ribs requires significant skill and labor in manufacturing.

In any of the embodiments disclosed herein, the support members 20 can be used to support acoustically problematic regions having too much mass, limited bending stiffness, or a combination of the two. Examples of features that fall into these categories include thin regions with low amounts of curvature, weight ports (like the one shown in FIGS. 16-18), slider tracks, styling features like grooves and pockets, and the edge 119 where top and sole portions 114, 112 connect to one another, as shown in FIGS. 20-25. The support members 20 can connect such features to stiffer regions or features, such as an inside wall of a hosel exit bore, face 116 stiffening structures, and other portions of a ribbon 118.

The support members 20 disclosed herein may be integrally formed with the rest of the body, via wax welding, direct additive manufacturing, or additive manufacturing for wax creation. If they are formed separately from the body, the choice of materials to be used can be limitless, and the support members 20 may be cast, injection molded, or created via additive manufacturing (FDM, SLS, DMLS, DLS, etc.) and then attached via welding, wax welding, bonding, or mechanical fastener(s). In some, preferred embodiments, the support members 20 may be composed of a composite material, which consists of plastic reinforced by fibers. The fibers can be short, long, or continuous, and may be selected from carbon, fiberglass, UHMWPE, Kevlar®, aramid, graphite, or boron.

When compared with prior art structural members, the support members 20 disclosed herein (1) are less susceptible to stress concentrations during the use of the structural part or component, (2) allow for improved flow and reduced porosity in investment casting operations, (3) allow for improved flow and reduced porosity in plastic injection molding, metal injection molding, compression molding, (4) are less susceptible to local stress concentrations and cracking during sintering of metal injection molding or 3D printed parts, (5) are less susceptible to local stress concentrations and cracking during the build process for laser-based 3D printing methods, like direct metal laser melting (DMLM) or direct metal laser sintering (DMLS); and (6) provide optimized acoustics. The support members 20 of the present invention also have a unique "organic" appearance that is not found in prior art structural golf club parts.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a face, a sole portion extending from a bottom edge of the face, a top portion extending from a top edge of the face, and a weight port disposed at a rear edge of the body, the body having a hollow interior and a volume of 150 to 500 cubic centimeters; and a structure comprising at least one support member, the structure extending between and connecting the sole portion, the top portion, and the weight port, wherein the at least one support member comprises a first end, a second end, a surface, an equivalent diameter, a spline, and a cross-sectional shape, wherein the equivalent diameter $D_E$ of a cross section taken at any point along the spline is calculated using the formula $D_E$=(4*A/pi)^(½), wherein A is an area of a cross-section of the support member, wherein the at least one support member has a length that is greater than $D_{EA}$, wherein $D_{EA}$ is defined as the average equivalent diameter along the length of the entire support member, wherein the equivalent diameter is always greater than 0.010 inch and less than 1.000 inch, and wherein the spline is curved and has a length that is at least three times the value of the average equivalent diameter $D_{EA}$.

2. The golf club head of claim 1, wherein the golf club head is a driver head.

3. The golf club head of claim 2, wherein the at least one support member connects to the sole portion at a first connection region and to the top portion at a second connection region, and wherein at least one of the first and second connection region has a constant surface curvature.

4. The golf club head of claim 1, wherein a volume occupied by the structure is no greater than 75% of a volume that would be occupied if an entire volume of the golf club head between the top portion and the sole portion were a solid.

5. The golf club head of claim 1, wherein the equivalent diameter is no less than 0.025 inch and no more than 0.500 inch at any point taken along the length of the at least one support member.

6. The golf club head of claim 5, wherein the equivalent diameter is no less than 0.050 inch and no more than 0.250 inch at any point taken along the length of the at least one support member.

7. The golf club head of claim 1, wherein the equivalent diameter changes continuously along the entire length of the spline.

8. The golf club head of claim 1, wherein the cross-sectional shape changes continuously along the entire length of the spline.

9. The golf club head of claim 1, wherein the at least one support member comprises first and second support members, and wherein the first support member is connected to the second support member.

10. The golf club head of claim 1, wherein the at least one support member does not comprise any sharp corners.

11. The golf club head of claim 1, wherein the at least one support member does not comprise any fillets with constant surface curvature.

12. A golf club head comprising:

a body comprising a face, a top portion, a bottom portion, and a rear portion connecting rearmost edges of the top portion to rearmost edges of the bottom portion and enclosing a hollow interior; and a support structure entirely disposed within the hollow interior, the support structure comprising a first support member and a second support member, wherein the first support member comprises a first end that connects with one of the top portion, bottom portion, and rear portion and a second end that connects with one of the top portion, bottom portion, and rear portion, wherein the second support member comprises a third end that connects with the first support member and a fourth end that connects with one of the top portion, bottom portion, and rear portion, wherein each of the first support member and the second support member comprises a central region that is suspended within the hollow interior and does not make contact with any other portion of the body, and wherein each one of the first support member and the second support member does not comprise any sharp corners.

13. The golf club head of claim 12, wherein each of the first end, the second end, and the fourth end connects with the bottom portion.

14. The golf club head of claim 12, wherein the first end connects with the top portion and the second end connects with the bottom portion.

15. The golf club head of claim 12, wherein the support structure dampens the acoustics of the golf club head upon impact with a golf ball and increases the modal frequency of at least one mode shape of the golf club head upon impact with a golf ball.

16. The golf club head of claim 12, wherein the body is composed of at least one metal alloy, and wherein the rear portion is selected from the group consisting of a rear edge and a rear ribbon.

17. The golf club head of claim 16, wherein the support structure is integrally formed with the body.

18. The golf club head of claim 12, wherein the support structure is composed of a material selected from the group consisting of plastic and composite.

19. The golf club head of claim 12, wherein the support structure is formed separately from the body via a process selected from the group consisting of metal injection molding, plastic injection molding, compression molding, and 3D printing.

20. The golf club head of claim 12, wherein each of the first support member and the second support member does not comprise any fillets with constant surface curvature.

* * * * *